US005251665A

United States Patent [19]

Schaufeld

[11] Patent Number: 5,251,665

[45] Date of Patent: Oct. 12, 1993

[54] MECHANISM FOR OPERATING MULTIPLE AIR FLOW CONTROL VALVES

[75] Inventor: Jerome J. Schaufeld, Framingham, Mass.

[73] Assignee: Phoenix Controls Corporation, Newton, Mass.

[21] Appl. No.: 916,906

[22] Filed: Jul. 20, 1992

[51] Int. Cl.[5] ..... F16K 11/04

[52] U.S. Cl. ..... 137/554; 137/595; 251/279

[58] Field of Search ..... 137/595, 601, 607, 554; 251/231, 232, 229, 58, 279, 129.04

[56] References Cited

U.S. PATENT DOCUMENTS

| | | | |
|---|---|---|---|
| 622,114 | 3/1899 | Burdett | 137/595 |
| 677,940 | 7/1901 | Carr | 251/231 X |
| 1,816,431 | 7/1931 | Helf | 137/601 X |
| 3,203,446 | 8/1965 | Smirra | 137/595 |
| 3,211,177 | 10/1965 | Phillips et al. | 137/607 X |
| 3,994,315 | 11/1976 | Muller et al. | 137/601 |
| 4,694,390 | 9/1987 | Lee | 137/554 X |
| 4,845,416 | 7/1989 | Scholl et al. | 251/129.04 X |

OTHER PUBLICATIONS

Data Sheet, Mark Hot, Inc., Arrgt Mark Air Valves Modular, no date.

*Primary Examiner*—Stephen M. Hepperle
*Attorney, Agent, or Firm*—Wolf, Greenfield & Sacks

[57] ABSTRACT

A mechanism is provided for operating multiple air flow control valves from a single actuator. The mechanism includes a yoke mounted to move with the drive shaft of the actuator and having a leg facing in the direction of each valve. The leg is resolvably connected, preferably by a link pivotably connected at each end, to a lever connected at its other end to a control shaft for the valve.

11 Claims, 5 Drawing Sheets

MECHANISM FOR OPERATING MULTIPLE AIR FLOW CONTROL VALVES

FIELD OF THE INVENTION

This invention relates to air flow control valves and more particularly to a mechanism for utilizing a single actuator to operate and control a plurality of air flow valves.

BACKGROUND OF THE INVENTION

In fume hood control systems, and in other applications where it is desired to accurately control air flow through a duct or other channel (hereinafter "duct"), Venturi or other air flow valves are frequently utilized. With such valves, there is a known and predictable relationship between the position of a valve control shaft and air flow through the valve.

While such valves provide effective air flow control, one problem has been that the ducts in which the valves are utilized are not of uniform size and shape. Since a single small valve mounted in a large duct cannot handle desired air flow through the duct, two techniques have heretofore been utilized for larger ducts, neither of which is completely satisfactory.

The first technique is to provide larger valves for the larger ducts. While this has the advantage of permitting a single actuator to control air flow in the same manner as for smaller ducts, large valves become long and unwieldly to work with. They can also be relatively heavy. In particular, because of the added length required for the larger valve, one 16 inch valve can weigh as much and take up as much area as two 12 inch valves. Since large valves also tend to magnify small errors, more precise manufacturing tolerances are required for such valves, making them more difficult and expensive to manufacture. In addition, Venturi valves normally have a generally circular cross section and therefore generally fit well in ducts which are substantially square or circular. However, because of space limitations in buildings, large ducts are typically rectangular, making it difficult to fit a large valve in such ducts. Finally, it is substantially less expensive to build one or two valve modules in selected sizes and to gang such modules to fill larger ducts than it is to build valves in all of the various sizes which might be required for different duct sizes.

However, ganging two or more smaller valves to fill a duct opening also presents some problems. One problem is that, with current designs, the position of each valve needs to be independently measured and a separate actuator provided to drive the valve. Separate electronic feedback controls are also required for each valve/actuator pair. This arrangement, with multiple actuators, is expensive, and is difficult to install and maintain. It also requires additional testing and calibration to assure that the various valve/actuator combinations are operating in synchronism.

This suggests that the advantages of a multi valve system for large ducts can be achieved without the disadvantages by providing a single actuator and a single control for all of the valves (or at least for selected numbers of the valves). In doing this, advantage is taken of the fact that the air flow through a given valve for a given valve shaft position is a constant which can be determined, so that if the shaft position for one valve is measured and the valves can be tied together so as to operate in tandem, it should be possible to use the single valve measurement to control the actuator driving all of the valves. However, in practice, it has been found difficult to design a mechanism for linking the valves to the actuator in a manner such that the valves move in tandem. In particular, the moment arms of such linkages tend to permit linkage skewing, resulting in uneven movement of the valves and thus in poor control of air flow. While efforts have been made to stiffen the linkages between the actuator and the valves, such efforts have not heretofore been completely successful, the linkages either not being stiff enough or being too bulky and cumbersome to be used effectively. As a result, use of ganged valves from a single actuator has not heretofore been commercially practical.

A need therefore exists for an improved mechanism for linking a single actuator to operate a plurality of valves, which mechanism assures that the valves move in tandem so that a valve position measured for one of the valves can be utilized to control the actuator to provide a desired precise air flow through the ganged valve combination.

SUMMARY OF THE INVENTION

In accordance with the above, this invention provides a mechanism for converting substantially linear movement of a valve actuator into predictable proportional, substantially linear movements of at least two air valve control shafts. The mechanism utilizes a yoke attached to move with the valve actuator, which yoke has a leg for each valve, each leg extending generally in the direction of the control shaft for the corresponding valve. There is also a lever for each valve which is pivotally connected at one end to the corresponding valve control shaft and extends in at least on plane toward the corresponding yoke leg. The yoke leg and the lever for a given valve are resolvably connected. For a preferred embodiment, this connection is a link pivotably connected at one end to the yoke leg for the corresponding valve and pivotably connected at the other end to the extending end of the corresponding lever.

Each lever is preferably pivoted at a selected point between its ends so that the valve shafts are moved by the actuator in a direction opposite from the direction of actuator movement The relative lengths of the yoke legs, the levers, and the links for each valve should be such that there is a predetermined ratio between the movement imparted to each valve shaft as a result of a given actuator movement. For the preferred embodiment, the movements of the valve shafts for a given actuator movement are identical.

Preferably, the yoke leg, link and lever for each valve are, when viewed in the direction of the valve shaft, in substantially the same plane. The axis of the actuator and of the valve shafts are all substantially parallel for preferred embodiments, and either two valves or four valves are controlled from a single actuator. Shaft position is measured for one of the valve shafts and means are provided for utilizing the measured position to control the actuator for operating all of the drive shafts. For preferred embodiments, measurement of shaft position is accomplished by measuring the position of the corresponding lever and the valve is a large air volume, low pressure valve such as a Venturi valve.

The foregoing and other objects, features and advantageous of the the invention will be apparent from the following more particular description of preferred embodiments of the invention as illustrated in the accompanying drawings.

IN THE DRAWINGS

DETAILED DESCRIPTION

Figure 1A:
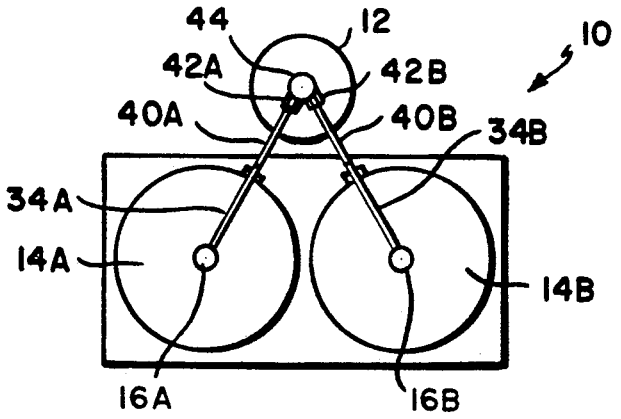
FIG. 1A is a diagrammatic front sectional view showing an actuator being utilized to control two valves in a rectangular duct.
Figure 1B:
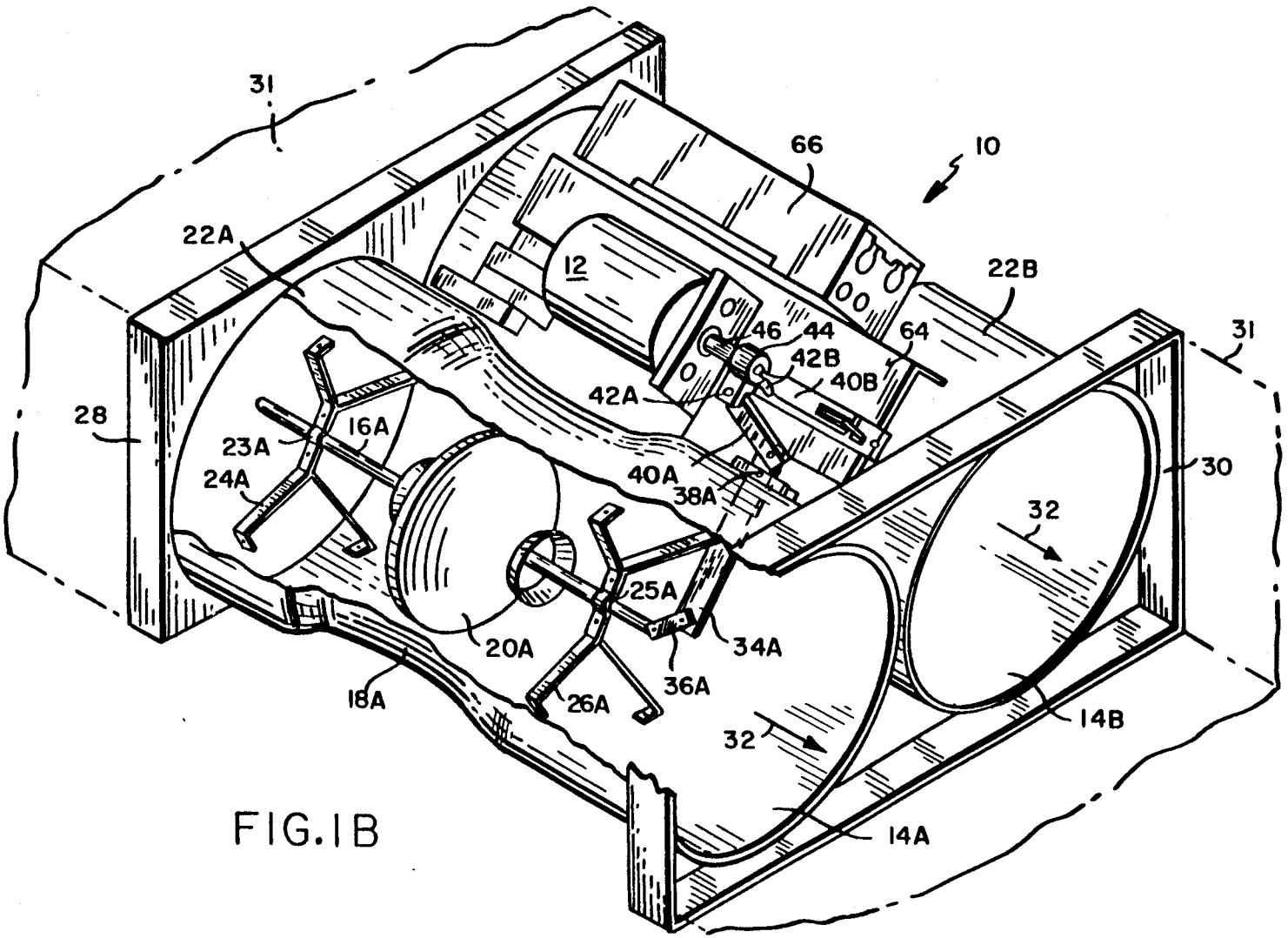
FIG. 1B is a partially cut away front top perspective view of a one actuator two valve assembly of the type shown in FIG. 1A.

Referring to FIGS. 1A and 1B, a valve assembly 10 is shown having a single actuator 12 and two valves 14A and 14B. Each valve 14 will be assumed to be a standard Venturi valve of a type currently available from Phoenix Controls Corporation, 55 Chapel Street, Newton, Massachusetts. Such valves are preferably low pressure (for example 0.6" to 3" water), large air volume (for example 60 cfm to 5,000 cfm) valves. However, the invention is not limited to use with such valves, and may be employed in other applications where air flow through a valve varies as a function of the position of a valve control shaft (16A,16B).

As may be best seen in FIG. 1B, each Venturi valve 14 has a reduced diameter portion (18A,18B) near its center and has a generally cone shaped plug (20A,20B) mounted to move with shaft 16. As plug 20 moves into reduced area 18, it reduces the size of the valve orifice, and thus reduces air flow through the valve. As plug 20 is moved out of reduced area 18, the air flow area of the valve increases, permitting greater air flow through the valve. Each shaft 16 is supported in the corresponding valve housing 22 by bearings (23A,23B) and (25A,25B) supported by brackets (24A,24B) and (26A,26B), respectively, the shaft being slidable forward and backward in the bearings.

Valve assembly 10 has a pair of end plates 28 and 30, with flanges on the plates which are adapted to mate with edges of the duct 31 in which the valve assembly is mounted to seal the duct so that air can only pass through valves 14. As viewed in FIG. 1B, the direction of air flow is indicated by arrow 32 pointing from plate 28 to plate 30.

The position of shaft 16, and thus of plug 20, in each valve 14 is controlled by a lever arm (34A,34B) which is pivotably connected to the corresponding shaft 16 through a linkage (36A,36B) and is pivoted at a pivot (38A,38B) which is on the outer edge of the corresponding housing 22. This linkage will be discussed in greater detail in conjunction with the description of FIGS. 4–6. As will also be discussed in greater detail later, the upper end of each lever 34 is connected through a link (40A,40B) to a corresponding leg (42A,42B) of a yoke 44. Yoke 44 is attached to move with the drive shaft 46 of actuator 12. In FIG. 1B, this connection is a direct connection, while in other figures the connection is indirect. As may be seen in FIG. 1A, and is better seen in FIG. 4, the element 34, 40 and 42 for a given valve are in substantially the same plane when viewed along the direction of air flow.

The various parts of the valve housing, plates, and other components may be of material commonly used for such parts including steel, aluminum, and the like.

Figure 2:
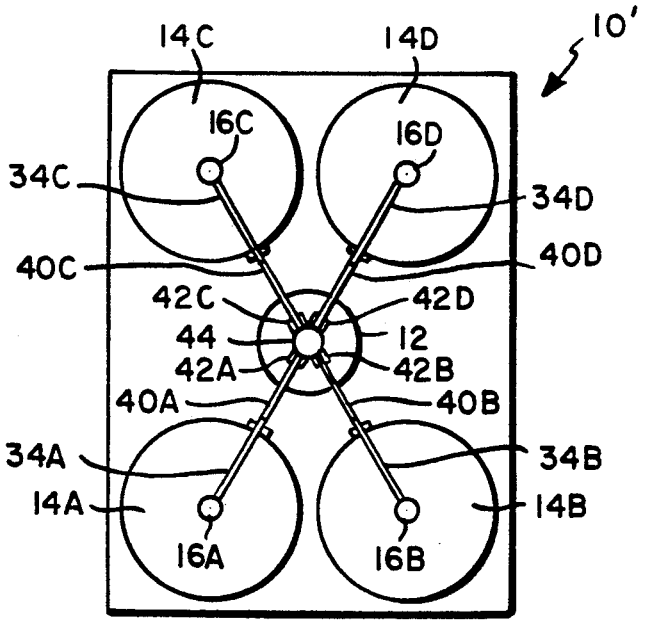
FIG. 2 is a diagrammatic front sectional view showing a single actuator being utilized to control four valves in a large, substantially square duct.
Figure 3:
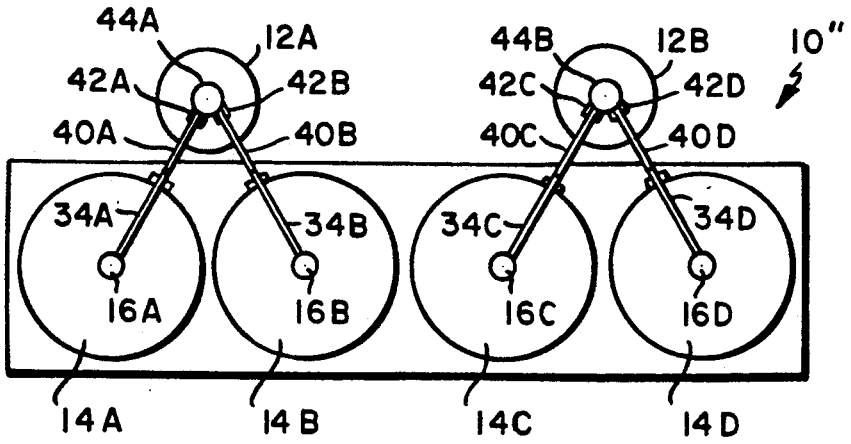
FIG. 3 is a diagrammatic front sectional view of a pair of actuators being utilized to control four valves in a large rectangular duct.

FIG. 2 shows an alternative embodiment 10' of the invention wherein yoke 44 has four legs 42A–42D, each of which leads to corresponding links 40 and levers 34 for a corresponding valve 14. Except for the difference of using four valves connected to operate off a single actuator rather than two valves, the embodiment of FIG. 2 is substantially the same as that shown in FIGS. 1A and 1B and operates in substantially the same manner. FIG. 3 shows a second alternative embodiment 10' for the valve assembly wherein two valve assemblies of the type shown in FIG. 1A are mounted side by side in a single valve assembly to provide a two actuator, four-valve embodiment. While this embodiment still provides some of the calibration problems associated with having multiple actuators, it presents less problems than for a configuration of this type employing four actuators.

Figure 4:
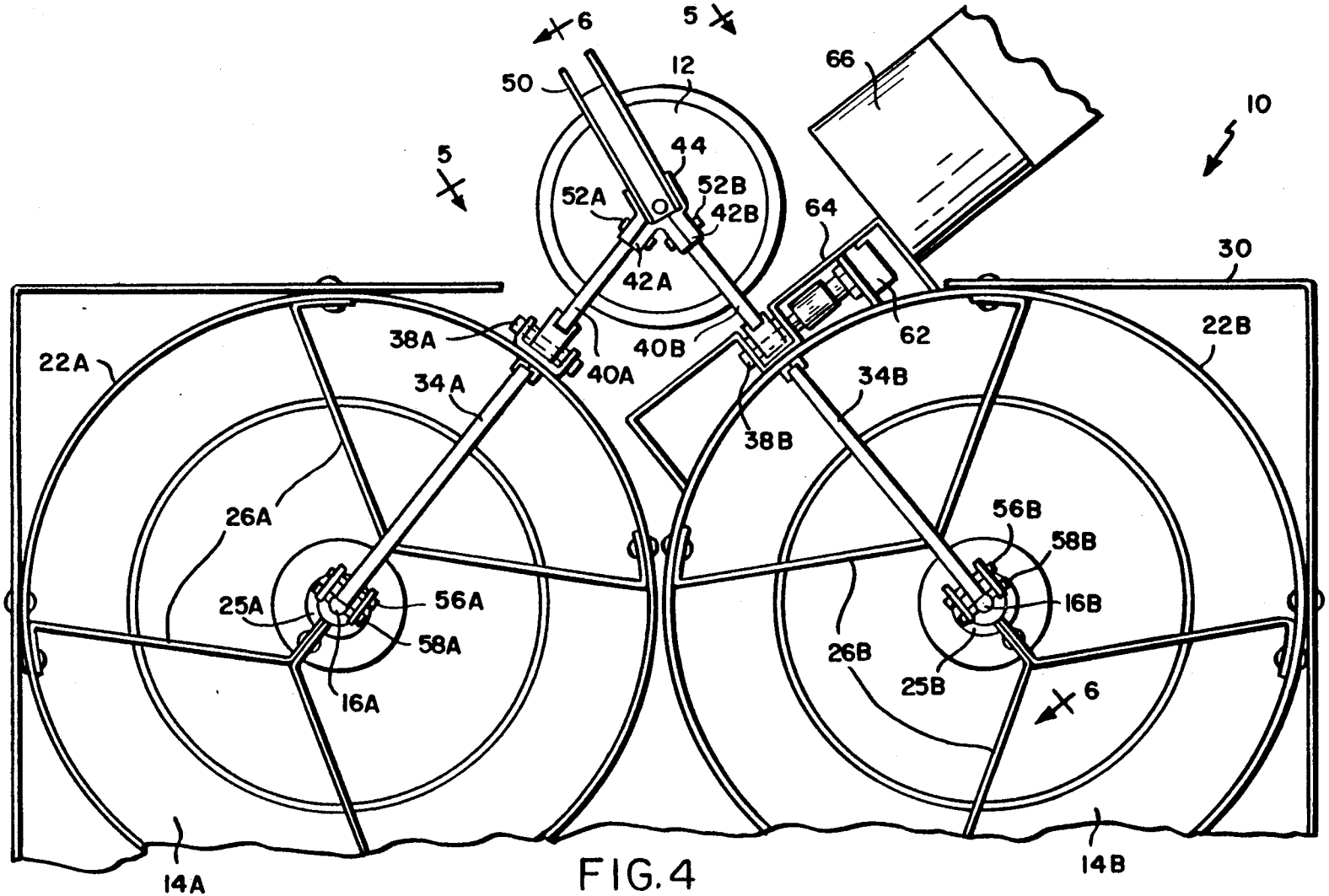
FIG. 4 is an enlarged front view of a two valve, one actuator preferred embodiment.
Figure 5:
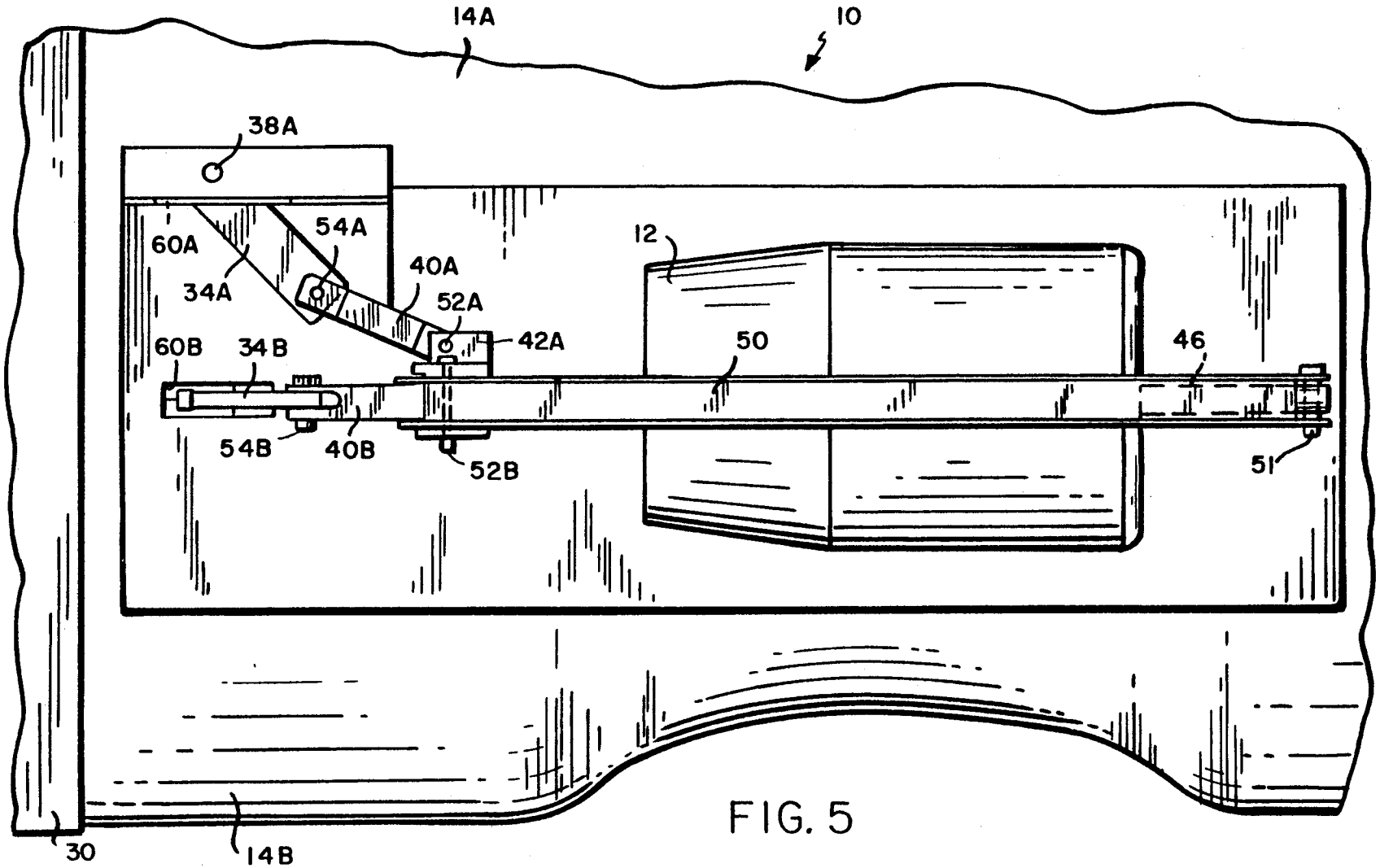
FIG. 5 is a top view generally looking in the direction of arrow 5 in FIG. 4.
Figure 6:
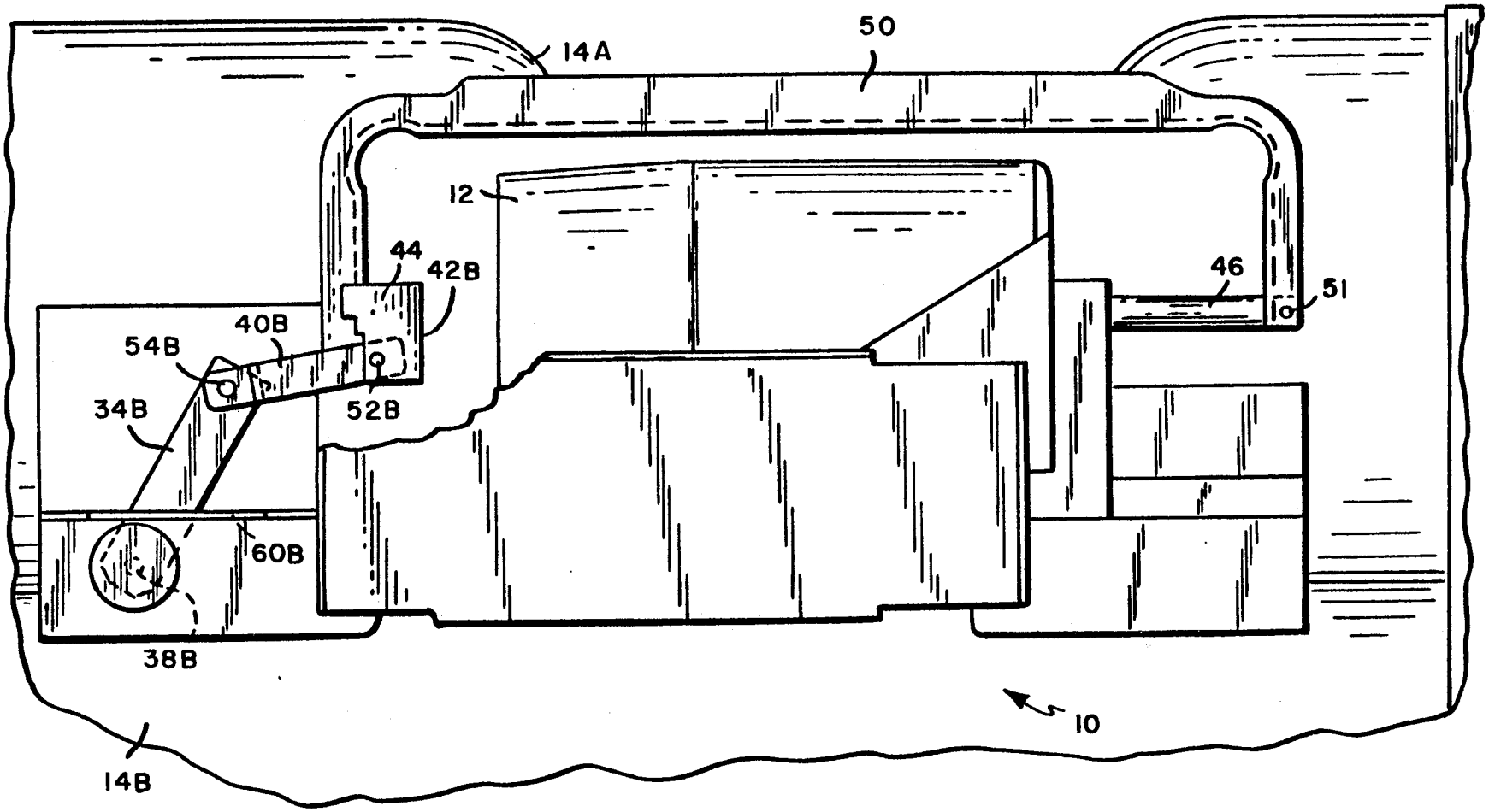
FIG. 6 is a side view generally looking in the direction of arrow 6 in FIG. 4.

FIGS. 4, 5 and 6 are more detailed views for the embodiment of the invention shown in FIGS. 1A and 1B. In particular, FIG. 4 is an enlarged and more detailed version of FIG. 1A. Like elements in all of the figures have been given the same reference numeral. The only difference between the embodiment shown in FIGS. 1A and 1B and that shown in FIGS. 4–6 is that yoke 44 in FIG. 1B is attached directly to shaft 46 so that when actuator 12 moves outward, the yoke, and thus the upper portion of lever arms 34, are moved to the right as shown in FIG. 1B or out of the paper as shown in FIG. 1A (or FIG. 4). This results in the corresponding cone or plug 20 being moved to the left to open the corresponding valve. Conversely, in FIGS. 4–6, the yoke 44 is attached at the end of one arm of a U-shaped bracket 50, with the end of the other leg of the bracket being attached to shaft 46. Thus, when shaft 46 is extended by the actuator, yoke 44 and the upper ends of lever arms 34 are driven into the paper as shown in FIG. 4 or to the right as shown in FIGS. 5 and 6, resulting in cones 20 being moved into corresponding throats 18 to reduce air flow through valves 14. Thus, while in each instance the valve shafts and the cones or plugs affixed thereto move in the opposite direction from the direction in which the actuator shaft is being moved, the direction of valve shaft movement, and thus the opening or closing of the valve is reversed for an actuation of the actuator.

In addition, FIGS. 4–6 more clearly show that each link 40 is connected to the corresponding yoke arm 42 by a cotter pin (52A,52B) and that each link 40 is connected to the corresponding lever arm 34 by a corresponding cotter pin (54A,54B), respectively. Similarly, there is a cotter pin (56A,56B) linking the lower end each lever 34 to the corresponding link 36 and a cotter pin (58A,58B) linking the other end of each link 36 to the corresponding valve shaft 16. The pivot 38 for each lever 34 is shown in more detail in FIGS. 4–6 as being a bolt passing through the lever arm, which bolt is mounted to the top of housing 22. A slot (60A,60B) is provided in the top of each housing 26 through which the corresponding lever arm 34 passes, the slot being long enough to permit movement of the lever arm from, for example, the position shown in FIG. 5 to a position approximately 90° to the left of such position.

The rotary position of lever 34B is detected by a detector 62 mounted to a bracket 64 and attached to the lever junction 38B. Signals from detector 62 are applied to an electronic flow controller circuit 66 which, in response to the outputs from detector 62, generates signals to actuator 12 to control the position of shaft 46 and thus the position of cones 20 in valves 14. Thus, a single position detector is utilized to control all flow valves being operated from a single actuator 12. This can be done since there are no linkages having moment arms between valve shafts, the drives for all valve shafts being linked at a common point to the actuator shaft. Thus, all valve shafts move in tandem so that a measurement of the position of one valve shaft is indicative of the position of all valve shafts.

While for the preferred embodiments, the movement of all valve shafts 16 is the same for a given movement of actuator 12, this is not a limitation on the invention. Thus, by adjusting the relative lengths of yoke arms 42, links 40 and levers 34, two valves 14 of different size might be utilized, with the relative movement of the two valve shafts being constant, for example, 3 to 2, but not being equal.

Further, while the actuator shaft 46 and the two valve shafts 16 have all been shown as being parallel for the preferred embodiment, this is also not a limitation on the invention. Therefore, the invention could be practiced, with, for example, the end of the actuator shaft not in contact with yoke 44 being higher or lower than the yoke end of the shaft, or the end of bracket 50 in contact with yoke 44, while still remaining within the teachings of the invention. It is also possible that in certain applications the end of one or both yoke arms 42 could be connected directly to the end of lever arm 34, rather than through intermediate link 40. However, since the relative movement at this junction involves movement in at least two dimensions (i.e., up and down as well as forward and backward), such linkage would have to be in a cam track or other resolvable linking mechanism which would provide the freedom of action for such relative movements. It is also possible to alter the nature of the various linkages and of the specific components used or of their inter relationship for specific applications. The ducts 31 in which the valve assemblies are mounted have also been assumed to be rectangular for the preferred embodiments. However, this invention has the flexibility to be used with ducts which are oval, circular, or having other shapes by use of a suitable number of valves of appropriate size and appropriately shaped end plates 28 and 30.

Thus, while various embodiments of the invention have been described in some detail above and various possible modifications on such embodiments have been mentioned, it will be apparent to those skilled in the art that these and other changes in form and detail ma be made by those skilled in the art without departing from the spirit and scope of the invention.

What is claimed is:

1. A mechanism for converting substantially linear movement of a valve actuator into predictable, proportioned, substantially linear movements of at least two air valve control shafts, the mechanism comprising:

a yoke attached to move with said valve actuator, said yoke having a leg for each valve, which leg extends generally in the direction of the corresponding valve control shaft;

a lever pivotably connected at one end to the corresponding valve control shaft and extending in at least one plane toward the corresponding yoke leg; and means for resolvably connecting the yoke leg for each valve to the extending end of the corresponding lever, each means for resolvably connecting including a link pivotably connected at one end to the yoke leg for the corresponding valve and at the other end to the extending end of the corresponding lever.

2. A mechanism as claimed in claim 1 wherein said lever is pivoted at a selected point between its ends, whereby the valve shafts are moved by the actuator in a direction opposite from the direction of actuator movement.

3. A mechanism as claimed in claim 2 wherein the relative lengths of the yoke legs, the levers and the links for each valve are such that there is a predetermined ratio between the movements imparted to each valve shaft as a result of a given actuator movement.

4. A mechanism as claimed in claim 3 wherein the movements of the valve shafts for a given actuator movement are identical.

5. A mechanism as claimed in claim 1 wherein, when viewed in the direction of the valve shaft, the yoke leg, link and lever for each valve are in substantially the same plane.

6. A mechanism as claimed in claim 1 wherein the axis of the actuator and of the valve shafts are substantially parallel.

7. A mechanism as claimed in claim 1 wherein two valve shafts are controlled from each actuator.

8. A mechanism as claimed in claim 1 wherein four valve shafts are controlled from each actuator.

9. A mechanism as claimed in claim 1 including means for detecting the position of one of said valve shafts, and means for utilizing the detected position to control said actuator.

10. A mechanism as claimed in claim 9 wherein said means for detecting measures shaft position by detecting the position of the corresponding lever.

11. A mechanism as claimed in claim 1 wherein said air valve is a Venturi valve.

* * * * *